US005249792A

United States Patent [19]

Albert

[11] Patent Number: 5,249,792

[45] Date of Patent: Oct. 5, 1993

[54] METHOD AND DEVICE FOR THE CONTINUOUS FORMATION OF A STACK OF FOLDED PRODUCTS STANDING ON EDGE

[75] Inventor: Kevin F. Albert, Barrington, N.H.

[73] Assignee: Heidelberg Harris, Inc., Heidelberg, Fed. Rep. of Germany

[21] Appl. No.: 919,366

[22] Filed: Jul. 23, 1992

[51] Int. Cl.[5] ..... B65H 29/34

[52] U.S. Cl. ..... 271/189; 271/215; 271/216; 271/258

[58] Field of Search ..... 271/177, 178, 179, 180, 271/189, 213, 214, 215, 216, 218, 258

[56] References Cited

U.S. PATENT DOCUMENTS

| | | | |
|---|---|---|---|
| 2,849,236 | 8/1958 | Beaulieu | 271/215 |
| 3,811,549 | 5/1974 | Preisig | 271/213 X |
| 4,065,123 | 12/1977 | Arrasmith et al. | 271/178 X |
| 4,361,318 | 11/1982 | Stobb | 271/215 X |
| 4,463,940 | 8/1984 | Mock | 271/215 X |

FOREIGN PATENT DOCUMENTS

| | | | |
|---|---|---|---|
| 3513353 | 1/1986 | Fed. Rep. of Germany . | |
| 3937944 | 4/1991 | Fed. Rep. of Germany | 271/218 |
| 0105859 | 5/1987 | Japan | 271/213 |

*Primary Examiner*—H. Grant Skaggs
*Assistant Examiner*—CarolLynn Druzbick
*Attorney, Agent, or Firm*—Herbert L. Lerner; Laurence A. Greenberg

[57] ABSTRACT

A method for the continuous formation of a stack of folded products standing on edge includes feeding folded products to a stack of folded products standing on edge. The stack is moved forward with a conveyor belt at a speed being matched to the feeding of the folded products to the stack. An interruption in the continuous feeding of the folded products to the stack is detected. A separating device is activated. The conveyor belt is stopped for the duration of the interruption. A device for the continuous formation of the stack of folded products includes a device for feeding the folded products in a stream to a stack of folded products standing on edge. The stack is moved forward on a conveyor belt at a speed being synchronized with the feeding of the folded products to the stack. At least one separating device contacts the folded products. A sensor monitors the stream of folded products and supplies output signals. A logic unit is connected to the sensor for recognizing an interruption in the stream of folded products from the output signals of the sensor. The logic unit is connected to the conveyor belt and to the at least one separating device for activating the at least one separating device upon the occurrence of an interruption in the stream and for stopping the conveyor belt for the duration of the interruption.

4 Claims, 1 Drawing Sheet

Figure 1:
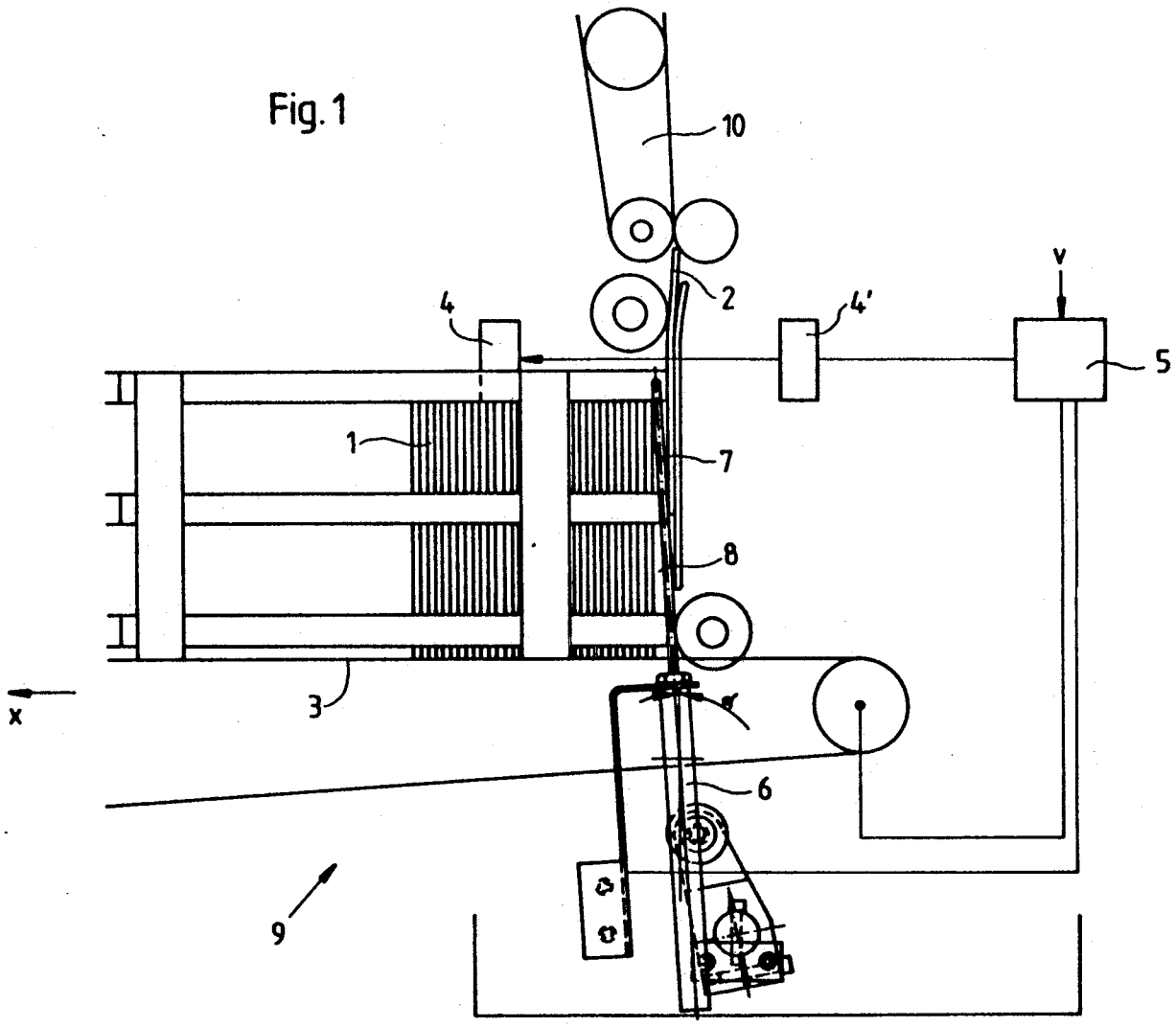

METHOD AND DEVICE FOR THE CONTINUOUS FORMATION OF A STACK OF FOLDED PRODUCTS STANDING ON EDGE

The invention relates to a method and a device for the continuous formation of a stack of folded products standing on edge, wherein a conveyor belt moves the stack at a speed which is synchronized with the feeding of the folded products to the stack.

After printed products in a folder have been folded according to desired formats, they are usually fed in shingled form through a tape and/or belt system onto a stack builder. Stack builders are known to either build stacks horizontally or vertically.

From German Published, Non-Prosecuted Application DE 35 13 353 A1, for example, a stack delivery has become known for folded sheets being stacked edgewise. In that case, the building of stacks occurs horizontally. The built stack is moved by a conveyor belt at a speed which is synchronized with the speed of feeding the folded products to the stack.

The horizontal stack formation represents a problem when the flow of the folded products occurs discontinuously. Since the conveyor belt moves regardless of the lack of folded products, a continuous, problem-free stack formation is no longer possible, after the feeding process of the product flow is renewed. Moreover, this renewal of stack formation can result in damage to the folded products. Usually the machine has to be stopped in order to remove damaged folded products, or the damaged product is removed manually. Such interruptions cause high, additional expenses, especially in fast running machines.

It is accordingly an object of the invention to provide a method and a device for the continuous formation of a stack of folded products standing on edge, which overcome the hereinafore-mentioned disadvantages of the heretofore-known methods and devices of this general type and which permit a problem-free stack formation after the flow of production has been interrupted.

With the foregoing and other objects in view there is provided, in accordance with the invention, a method for the continuous formation of a stack of folded products standing on edge, which comprises feeding folded products to a stack of folded products standing on edge; moving the stack forward with a conveyor belt at a speed being matched or tuned to the feeding of the folded products to the stack; detecting an interruption in the continuous feeding of the folded products to the stack; activating a separating device; and stopping the conveyor belt for the duration of the interruption.

When the flow of product resumes, it is detected, the renewal of the stack formation is assisted, and the conveyor belt is restarted.

In accordance with another mode of the invention, there is provided a method which comprises feeding the folded products to the stack in a shingled stream. In accordance with a further mode of the invention, there is provided a method which comprises feeding the folded products to the stack individually. The method and the device according to the invention are suited for both applications.

In accordance with an added mode of the invention, there is provided a method which comprises standing the folded products on a folded edge in the stack. Damage to the folded products is avoided for the most part, by the stacking or touch-down of the folded products on the stable, firm, folded edge.

With the objects of the invention in view, there is also provided a device for the continuous formation of a stack of folded products standing on edge, comprising means for feeding folded products in a stream or flow to a stack of folded products standing on edge; a conveyor belt on which the stack is moved forward or transported at a speed being synchronized with the feeding of the folded products to the stack; at least one separating device for contacting the folded products; a sensor for monitoring or observing the stream of folded products and supplying output signals; and a logic unit connected to the sensor for recognizing an interruption in the stream of folded products from the output signals of the sensor, the logic unit being connected to the conveyor belt and to the at least one separating device for activating the at least one separating device upon the occurrence of an interruption in the stream and for stopping the conveyor belt for the duration of the interruption.

In accordance with another feature of the invention, the stream of folded products defines a given plane, and the at least one separating device includes separating cylinders and a rod having an axis, the rod being extended in a direction parallel to the axis upon activation of the separating cylinders for forming an acute-angle volume or room segment with the given plane.

On one hand, the rods of the separating cylinders prevent a tipping over of the already built stack. On the other hand, the rods form an acute-angled volume segment with the plane defined by the stream of the folded products that are feeding in, which serves for the renewed acceptance of the folded products which are feeding in, after an interruption in the flow of folded products.

In accordance with a further feature of the invention, the logic unit retracts the rod into the separating cylinders and simultaneously puts the conveyor belt in motion to resume movement synchronized to the speed of feeding the folded products to the stack, upon receiving the output signals of the sensor indicating a renewed, continuous feeding of the folded products.

In accordance with a concomitant feature of the invention, the sensor is a "through-beam" or transmitted light type sensor, in which a radiation source and a receiver in front of the stack builder are disposed at both sides of the product flow.

Other features which are considered as characteristic for the invention are set forth in the appended claims.

Although the invention is illustrated and described herein as embodied in a method and a device for the continuous formation of a stack of folded products standing on edge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

The drawing is a diagrammatic, side-elevational view of a device according to the invention.

Referring now to the single figure of the drawing in detail, there is seen an illustration of a device according to the invention, in which folded products 2 coming from a non-illustrated sheet processing machine are fed to a stack builder 9 by a tape system 10. During normal operation, i.e., without previous interruption of the product flow, a stack or log 1 of folded products or signatures 2 is moved forward on a conveyor belt 3, in the x direction, in time with the folded products 2 feeding-in. A synchronization between sheets feeding-in and the movement of the conveyor belt 3 is controlled by a logic unit 5. A change-over from a shingled stream of folded products feeding-in to individual folded products 2 feeding-in is possible, through simple programming.

A "through-beam" or transmitted light type of sensor 4, 4' which is formed of a radiation source and a receiver, is disposed in a region in front of the stack builder 9. In the case of a shingled stream, an increase of intensity at the receiver is a distinct sign of a gap in the product flow, since the receiver then receives the maximally emitted radiation from the radiation source. The interruption is signaled directly to the logic unit 5 through wires, which in turn activates and stops the conveyor belt 3, and activates separating cylinders 6 of a separating device, which are described in greater detail below.

The activation of separating cylinders 6 causes axially parallel rods 7 to be extended. The separating cylinders 6 are disposed in such a way that the extended rods 7 form a space or volume segment or funnel 8 with the feeding-in direction of the folded products 2, having an acute angle alpha. Moreover, the rods support the stack 1 and prevent a tipping over of the folded products 2.

The folded products which are newly fed-in after an interruption, are received in this funnel 8. A change in radiation intensity, as received by the sensor 4, occurs when folded products 2 reenter the stack builder 9. As soon as the logic unit 5 receives corresponding output signals, a deactivation of the separating cylinders 6 is effected, i.e. the rods 7 are retracted into the separating cylinders 6, and the conveyor belt 3 is again activated. This feature permits a problem-free start for the formation of the stack 1, after an interruption in the feeding-in of the folded products 2.

As has been mentioned above, the device according to the invention is also applicable without reservation if the folded products 2 are fed individually to the stack builder 9. In this case, the logic unit is programmed in such a way that it automatically considers a periodic change of the output signals of the sensors 4, 4', and an activation of the separating cylinder 6 is effected only when deviations occur in reference to the periodicity of the output signal of the sensors 4, 4'. This occurs, for example, upon exceeding a time period which is dependent on a feeding-in speed v between two successive folded products 2, that is supplied to the logic unit 5.

I claim:

1. A device for the continuous formation of a stack of folded products standing on edge, comprising:

means for feeding folded products in a stream to a stack of folded products standing on edge;

a conveyor belt on which the stack is moved forward at a speed being synchronized with the feeding of the folded products to the stack;

at least one separating device for contacting the folded products;

a sensor for monitoring the stream of folded products and supplying output signals; and a logic unit connected to said sensor for recognizing an interruption in the stream of folded products from the output signals of said sensor, said logic unit being connected to said conveyor belt and to said at least one separating device for activating said at least one separating device upon the occurrence of an interruption in the stream and for stopping said conveyor belt for the duration of the interruption.

2. The device according to claim 1, wherein the stream of folded products define a given plane, and said at least one separating device includes separating cylinders and a rod having an axis, said rod being extended in a direction parallel to the axis upon activation of said separating cylinders for forming an acute-angle volume segment with the given plane.

3. The device according to claim 2, wherein said logic unit retracts said rod and puts said conveyor belt in motion upon receiving the output signals of said sensor indicating a continuous feeding of the folded products.

4. The device according to claim 1, wherein said sensor is a through beam sensor.

* * * * *